United States Patent [19]

Pagano

[11] Patent Number: 4,651,144

[45] Date of Patent: Mar. 17, 1987

[54] SECURITY HOUSING WITH MOTION DETECTOR

[76] Inventor: Raymond V. Pagano, 2675C Lithonia Ind. Blvd., Lithonia, Ga. 30058

[21] Appl. No.: 727,749

[22] Filed: Apr. 26, 1985

[51] Int. Cl.[4] ..... G08B 23/00
[52] U.S. Cl. ..... 340/693; 340/541
[58] Field of Search ..... 340/691, 693, 541; 358/108, 229

[56] References Cited

U.S. PATENT DOCUMENTS

| | | | |
|---|---|---|---|
| 3,285,151 | 11/1966 | Black | 358/229 X |
| 4,320,949 | 3/1982 | Pagano | 358/108 X |
| 4,344,071 | 8/1982 | Allen | 340/693 X |

OTHER PUBLICATIONS

Mountain West, "Security Catalog and Reference Manual", 19th edition, p. 63, 1985.

*Primary Examiner*—James L. Rowland
*Assistant Examiner*—Thomas J. Mullen, Jr.
*Attorney, Agent, or Firm*—James B. Middleton

[57] ABSTRACT

A security housing having the appearance of a housing containing a surveillance camera, the housing including a dummy camera and a motion detector. The appearance of the housing is changed when motion is detected to give the impression that the apparatus is in fact a surveillance camera. The dome that normally conceals the camera is lighted, and this light is extinguished when motion is detected. A spot light or flood light lights the area in response to detection of motion, and an audible alarm may be sounded.

5 Claims, 5 Drawing Figures

SECURITY HOUSING WITH MOTION DETECTOR

It is known to utilize television cameras as surveillance cameras, and to mount the surveillance cameras within a dome-like structure for protection of the camera and the associated equipment. It is also known that one of the primary advantages of surveillance cameras is the deterrent effect of a person's knowing he is being watched. Given this fact, it has become relatively common practice to mount a dome-like structure of the type that normally conceals a surveillance camera, and either to omit the camera or to utilize a dummy camera. This is considerably cheaper than use of the actual surveillance camera, but it has the deterrent effect in that people believe they are being watched.

The difficulty with the prior art system of utilizing a dummy housing and/or a dummy surveillance camera is that, at least in time, people may observe closely enough to realize that the camera is a dummy, or that there is in fact no camera within the housing.

SUMMARY OF THE INVENTION

This invention relates generally to security methods and apparatus, and is more particularly concerned with a security housing having a dummy camera with means for imitating a live surveillance camera.

The present invention provides a conventional security housing including the usual external paraphernalia to provide the appearance of a housing having a surveillance camera therein. The housing includes a dummy camera, or may include no camera; however, a sensing means is utilized for causing visual changes in the security housing. In the preferred embodiment of the invention, the security housing includes a motion detector and one or more lights, the lights being turned on or off in response to detection of motion by the motion detector. In one embodiment of the invention, the device may also include driving means for causing oscillatory motion of the dummy camera.

The present invention therefore provides a security housing having means for detecting motion in the vicinity of the security housing, and signal means operable in response to the detection of motion for providing an indication that the security housing contains surveillance means.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENTS

Figure 1:
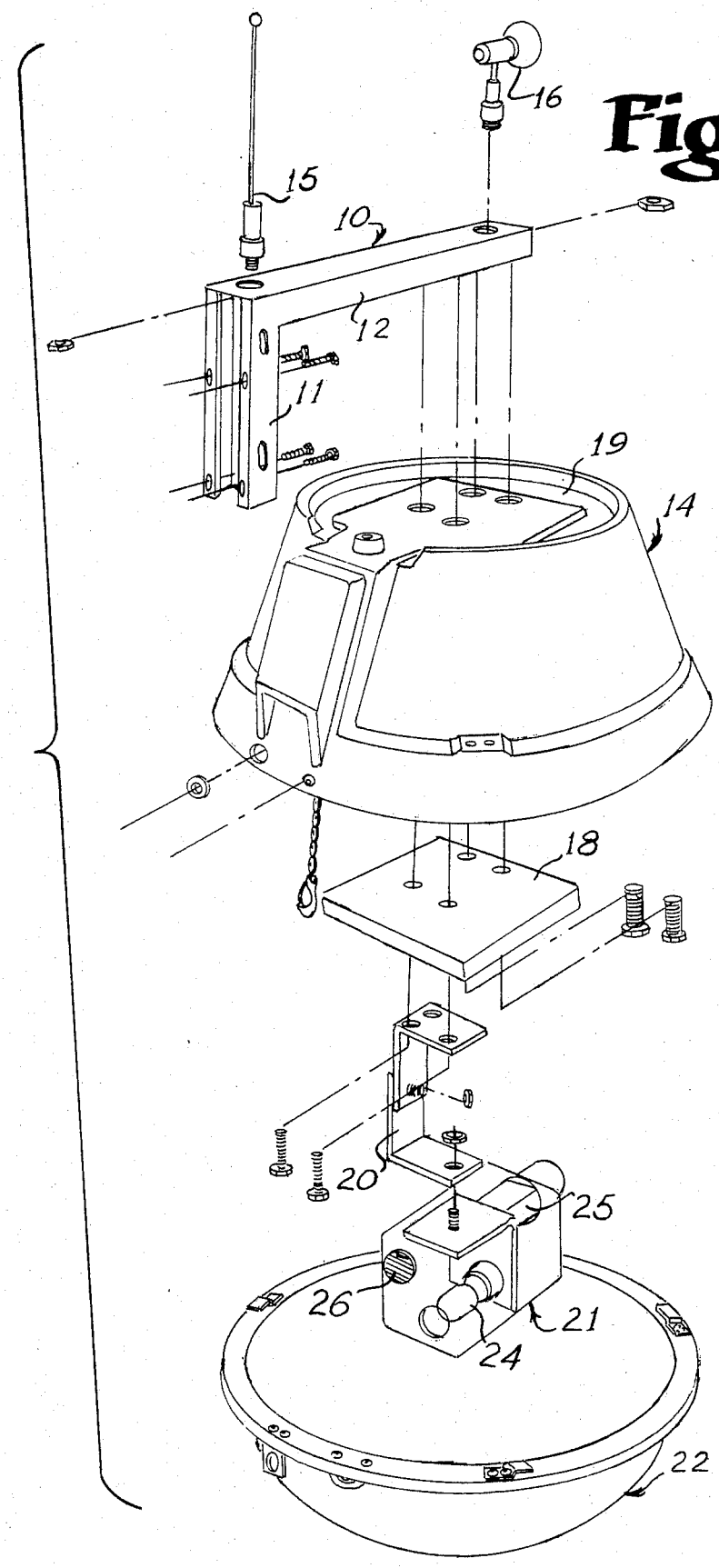
FIG. 1 is an exploded perspective view illustrating apparatus made in accordance with the present invention.

Referring now more particularly to the drawings, and to those embodiments of the invention here presented by way of illustration, it should first be realized that the security housing illustrated in the drawings is substantially that disclosed in the U.S. patent to the same inventor, U.S. Pat. No. 4,320,949, issued Mar. 23, 1982. This patent discloses the security housing with a surveillance camera, and that disclosure is incorporated herein by reference. The present invention utilizes the same housing, but the present invention relates to the specific apparatus used in conjunction with the housing, and to the manner of use of such equipment.

With the foregoing in mind, it will be seen that the embodiment of the invention illustrated in FIG. 1 of the drawings includes a mounting bracket generally designated at 10, the mounting bracket including a vertical arm 11 and a horizontal arm 12. As is conventional, the vertical arm 11 would be secured to a post, building or other support structure, while the arm 12 will be attached to the cover generally designated at 14. The mounting bracket 10 mounts an antenna 15 and a spotlight or floodlight 16. These will be discussed in more detail hereinafter.

The cover 14 is a generally frustoconical member for receiving the various apparatus of the usual surveillance camera. Since the apparatus herein disclosed is intended to create the impression that a surveillance camera is present, the cover 14 is substantially the same as for the housing for an actual surveillance camera.

Below the cover 14, it will be seen that there is a mounting plate 18 to be received against the upper wall 19 of the cover 14, the mounting plate 18 carrying a bracket 20 which depends therefrom. The bracket 20, at its lower end, mounts the dummy camera generally indicated at 21. Finally, the dome generally indicated at 22 will be used, as is conventional, to close the cover 14 and partially conceal the dummy camera 21.

Figure 2:
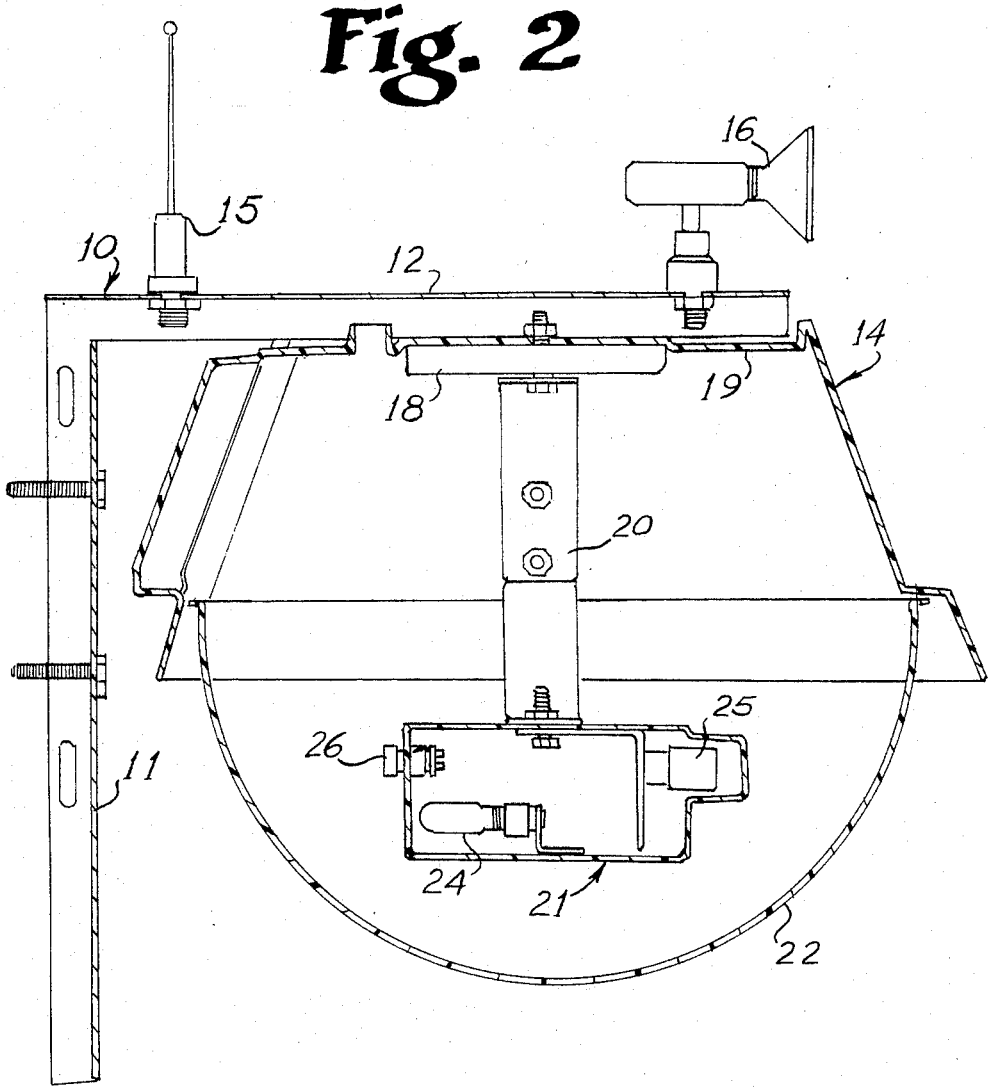
FIG. 2 is a cross-sectional view taken generally diametrically through the apparatus of FIG. 1, the apparatus being assembled.

With the foregoing general description in mind, attention is directed to FIGS. 1 and 2 of the drawings for a complete understanding of the invention disclosed. It will be seen that the assembled apparatus as shown in FIG. 2 has the complete appearance of a housing having a surveillance camera therein. To further this impression, the security housing includes a light indicated at 24, the light 24 being within the dummy camera 21. Also within the dummy camera 21, there is a motion detector 25, and a sounding device, or audible alarm, 26.

Those skilled in the art will understand that motion sensing devices are well known in the art, and any conventional device will operate acceptably within the security housing of the present invention.

From the foregoing description, the embodiment of the invention shown in FIGS. 1 and 2 of the drawings should be understandable. It will be realized that the overall security housing will have the same appearance as a security housing that is in fact used for a surveillance camera. In addition to this external appearance, the device includes the antenna 15 to give the indication that the device is in radio contact with someone who is monitoring the device. Because of the presence of the motion detector 25, it will be understood that, when a person, vehicle or the like moves while in the vicinity of the security housing, the motion detector 25 will be activated.

It is contemplated that the light 24 will be a colored bulb of some type to lend the dome 22 an appearance of activity, and the color may be so selected as to give the dome a somewhat eerie appearance. When the motion detector 25 detects motion, the motion detector will operate electrical means to turn off the lamp 24, but to turn on the lamp 16. The lamp 16 may be a spotlight or a floodlight, so this gives the distinct impression that the area is being lighted for better surveillance. In addition, a sounding device 26 may be operated both to carry out the impression that the security housing is in fact a surveillance device, and to have the benefit of the deterrent effect of an audible alarm.

Figure 3:
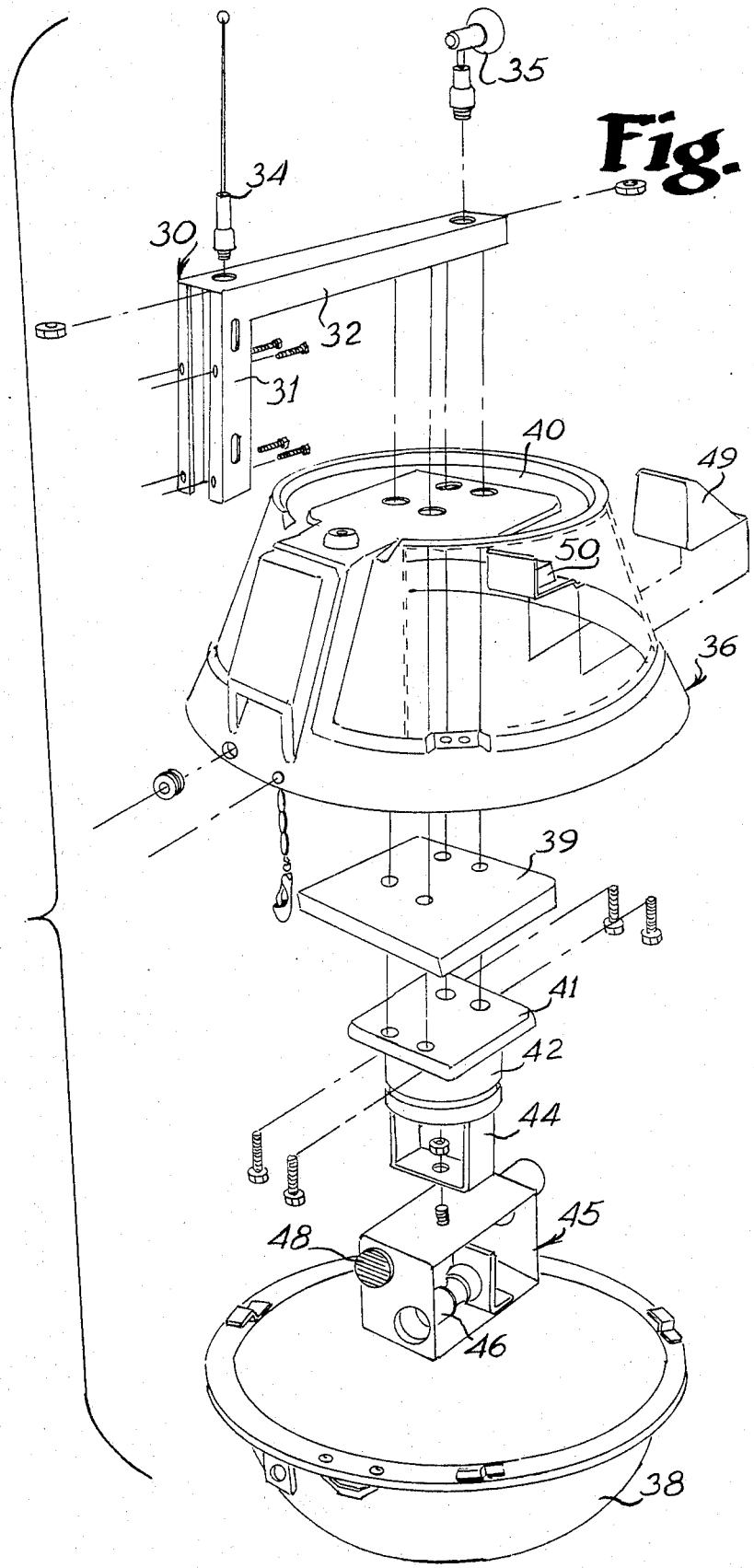
FIG. 3 is a view similar to FIG. 1, but showing a different embodiment of the invention.
Figure 4:
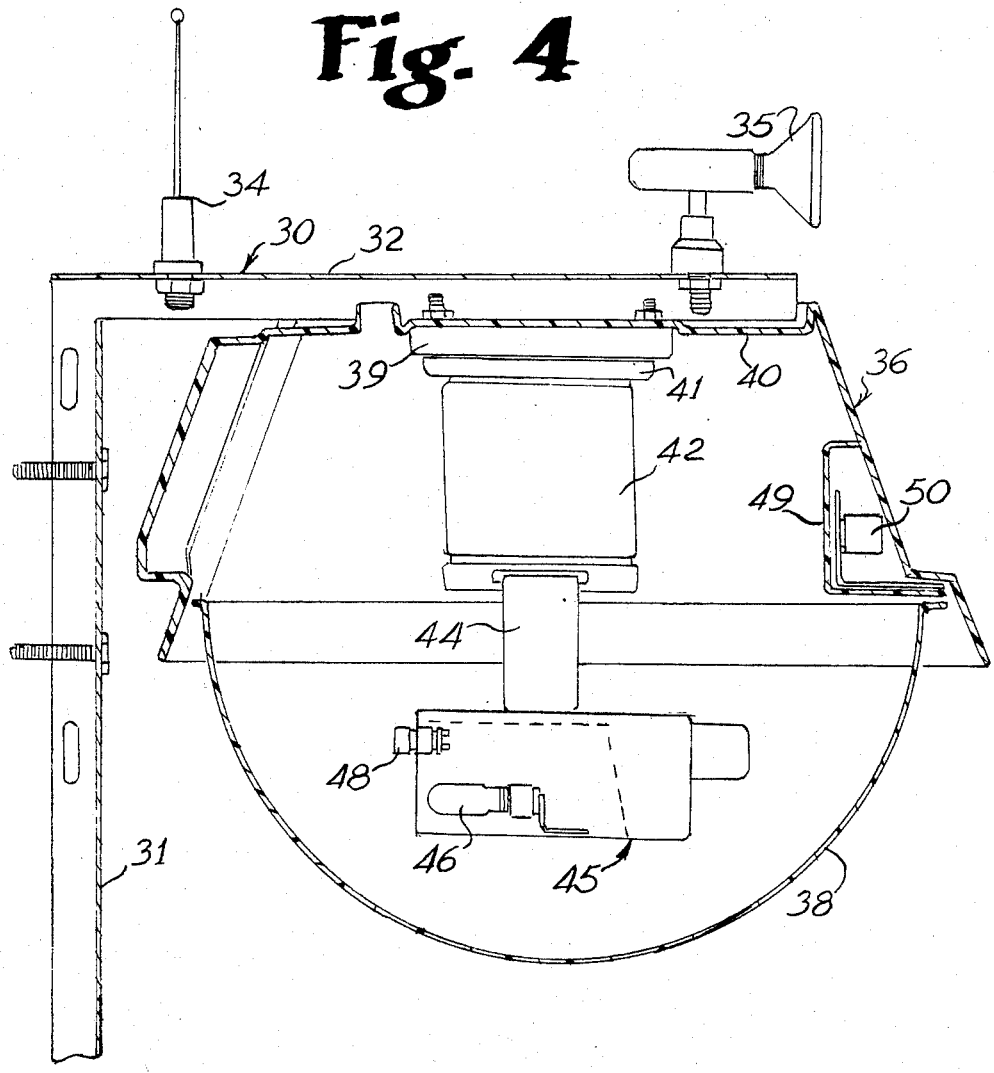
FIG. 4 is a view similar to FIG. 2, but taken through the embodiment shown in FIG. 3; and, FIG. 5 is a schematic illustration showing the electrical control arrangement.

Attention is next directed to FIGS. 3 and 4 of the drawings for a discussion of the modified form of the invention. It will be seen that this embodiment of the invention also includes the mounting bracket generally designated at 30 and having the vertical arm 31 and the horizontal arm 32. The horizontal arm 32 carries an antenna 34 and a lamp 35. A cover 36 for the security housing is carried by the extending end of the horizontal arm 32, and there is a dome 38 to conceal the apparatus within the housing and close the open lower end of the cover 36.

This embodiment of the invention also includes a mounting plate 39 to be fixed to the upper wall 40 of the cover 36, the mounting plate 39 in this embodiment carrying a base plate having a motor 42 thereon. The drive motor 42, then, carries a depending bracket 44 which receives the dummy camera 45. As in the previously described embodiment, the dummy camera 45 includes a lamp 46 and a sounding device 48.

In this embodiment of the invention, instead of including a motion detector within the dummy camera 45, the motion detector is mounted at the front of the cover 36, carried by a bracket 49.

Thus, the motion detector 50 is stationarily mounted at the front of the cover 36 for operation generally as described in conjunction with the previous embodiment of the invention.

With the foregoing description in mind, operation of this embodiment of the invention should now be understandable. As before, the security housing will have the total appearance of a conventional security housing having a surveillance camera therein. The antenna 34 assists in the illusion by indicating radio contact.

In this embodiment of the invention, there is included a drive motor 42. It will be understood that the drive motor 42 includes a motor and appropriate gearing so that the bracket 44 will be caused to oscillate slowly, carrying the dummy camera 45 through such oscillations. This will give the distinct appearance of a camera scanning an area. Meanwhile, the lamp 46 may light the dome 38 so the motion will be apparent even in the dark.

Since the motion detector would be constantly activated if it were carried by a constantly moving dummy camera, the motion detector 50 in this embodiment is carried by the stationary cover 36. The bracket 49 is conveniently fixed to the front of the cover and carries the motion detector 50 therein. Again, as in the previously described embodiment, when the motion detector 50 detects motion in the vicinty of the security housing, the lamp 46 may be turned off, and the spotlight or floodlight 35 may be turned on, and the sounding device 48 may be activated.

Figure 5:
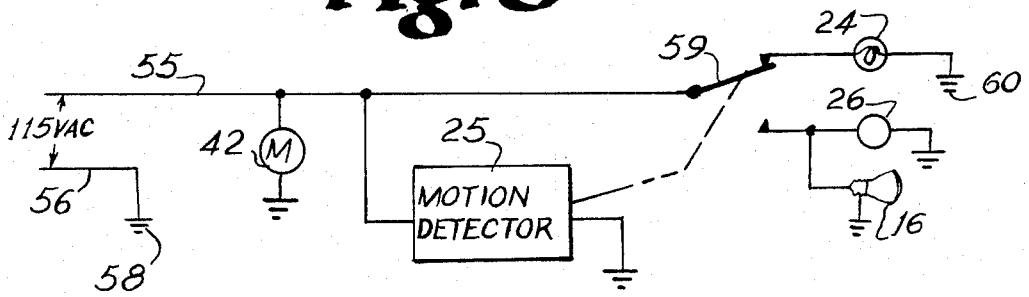

Those skilled in the art will readily understand the electrical connections necessary for causing the activity described. Nevertheless, attention is directed to FIG. 5 for a general description of the electrical arrangement. FIG. 5 is arranged to illustrate the electrical connections of the embodiment shown in FIGS. 3 and 4, but the only difference between the two embodiments is the addition of the motor 42. Therefore, the single schematic diagram will serve for both embodiments of the invention.

It will be seen that a supply voltage is designated, and the hot leg is designated at 55 while the ground leg is designated at 56. The ground leg is shown as running to a ground 58. The hot leg 55 is connected to the common point of a switch designated at 59, the switch 59 having a normal point connected through the lamp 24 and to ground. The transfer point of the switch 59 is connected to the lamp 16 and to the sounding device 26. Thus, it will be seen that the switch 59 will cause the lamp 24 or 46 to be illuminated, or the switch will be transferred to cause illumination of the lamp 16 or 35 and the sounding device 26 or 48.

The switch 59 is operated by the motion detector 25, or 50. Again, those skilled in the art will readily realize that the conventional motion detectors include relay means having, at least effectively, a double throw switch such as the switch 59, so the arrangement shown in FIG. 5 of the drawings will be readily understandable. In the event the motor 42 is utilized, it will of course be connected to the hot line 55, with the opposite side of the motor connected to ground so the motor will operate at all times.

It will therefore be seen that the present invention provides a security housing including a dummy camera so that the security housing appears precisely as a security housing having a surveillance camera therein. In order to maintain this appearance, the present invention includes motion detecting means, activation of which causes a change in the visual appearance of the security housing, and may include both visual and audible signals or the like. In one embodiment of the invention, the dummy camera may be caused to oscillate to give the impression of a scanning camera.

Since the deterrent effect of a dummy camera is in the belief that the security housing in fact contains a surveillance camera, the present invention can have a significant deterrent effect without the extremely high cost associated with a security housing that in fact contains a surveillance camera. Even with the embodiment of the invention including the oscillating dummy camera, it will be understood that this is a very small cost compared to the use of an actual surveillance camera, since use of a surveillance camera requires both purchase of the equipment for carrying out the surveillance, and the hiring of personnel to view the monitors.

While various specific forms of lamps and the like have been illustrated in the drawings and discussed herein, it will be understood that various light arrays and the like may be utilized, and various light combinations may be utilized to give various impressions of the security housing. Also, audible signals may be utilized in conjunction with the light display, or alternatively therewith.

It will therefore be understood that the particular embodiments of the invention here presented are by way of illustration, and are meant to be in no way restrictive; therefore, numerous changes and modifications may be made, and the full use of equivalents resorted to, without departing from the spirit or the scope of the invention as defined in the appended claims.

I claim:

1. In combination, a security housing comprising a cover adapted to receive a surveillance camera therein, means for mounting said security housing, and a dome for closing said cover and normally partially concealing the surveillance camera, a dummy surveillance camera mounted within said security housing so as to appear to be surveillant of an area in the vicinity of said security housing, first light means within said dummy camera for illuminating said dome for rendering said dome visible in the dark, motion detecting means carried by said housing for detecting motion in said area in the vicinity of said security housing, signal means carried by said housing, and circuit means for operating said signal means when said motion detecting means detects motion in said area in the vicinity of said security housing, said signal means including a second light for illuminating said area in the vicinity of said security housing, the arrangement being such that said security housing remains dormant until said motion detecting means detect motion, then said security housing responds to the motion to indicate surveillance of said area in the vicinity of said security housing.

2. The combination as claimed in claim 1, said signal means further including an audible alarm.

3. The combination as claimed in claim 1, and wherein said motion detecting means is mounted in said dummy camera.

4. The combination as claimed in claim 1, and further including oscillating means mounted within said housing, said oscillating means having said dummy camera depending therefrom for oscillation of said dummy camera.

5. The combination as claimed in claim 4, and wherein said motion detecting means is mounted within said cover of said security housing.

* * * * *